United States Patent [19]

Ecer

[11] Patent Number: 4,592,252

[45] Date of Patent: Jun. 3, 1986

[54] ROLLING CUTTERS FOR DRILL BITS, AND PROCESSES TO PRODUCE SAME

[75] Inventor: Gunes M. Ecer, Irvine, Calif.

[73] Assignee: CDP, Ltd., Newport Beach, Calif.

[21] Appl. No.: 743,816

[22] Filed: Jun. 12, 1985

Related U.S. Application Data

[62] Division of Ser. No. 633,508, Jul. 23, 1984, Pat. No. 4,562,892.

[51] Int. Cl.[4] ..... B22F 7/08

[52] U.S. Cl. ..... 76/108 A; 419/6; 419/8; 419/48

[58] Field of Search ..... 175/371, 409; 29/DIG. 31; 76/108 A, 108 R, 101 E, 101 R, DIG. 11; 419/6, 8, 48

[56] References Cited

U.S. PATENT DOCUMENTS

| | | | |
|---|---|---|---|
| 3,235,316 | 2/1966 | Whanger | 308/8.2 |
| 3,310,870 | 3/1967 | Parikh . | |
| 3,356,496 | 12/1967 | Hailey | 419/48 |
| 3,453,849 | 7/1969 | Clarke et al. . | |
| 3,689,259 | 9/1972 | Hailey | 419/48 |
| 3,721,307 | 3/1973 | Mayo | 175/372 |
| 3,984,158 | 10/1976 | Sorensen et al. | 308/8.2 |
| 3,995,917 | 12/1976 | Quinlan | 308/8.2 |
| 4,074,922 | 2/1978 | Murdoch | 308/8.2 |
| 4,108,692 | 8/1978 | Quinlan | 175/409 |
| 4,173,457 | 11/1979 | Smith | 175/409 |
| 4,365,679 | 12/1982 | Nederveen et al. | 76/108 A |
| 4,368,788 | 1/1983 | Drake | 76/108 A |
| 4,372,404 | 2/1983 | Drake | 175/374 |

*Primary Examiner*—Roscoe V. Parker

*Attorney, Agent, or Firm*—William W. Haefliger

[57] ABSTRACT

A roller bit cutter comprises a tough, metallic, generally conical and fracture resistant core having a hollow interior, the core defining an axis; an annular, metallic, radial bearing layer carried by the core at the interior thereof to support the core for rotation, the bearing layer extending about the core axis; a wear resistant outer metallic layer on the exterior of the core; metallic teeth integral with the core and protruding outwardly therefrom, at least some of the teeth spaced about the axis; and an impact and wear resistant layer on each tooth to provide hard cutting edges as the bit cutter is rotated about the core.

43 Claims, 15 Drawing Figures

EVERY CONTINUOUS ARROW PATH FROM STEP 1 TO STEP Nº 14 (SEE TABLE I) REPRESENTS A MANUFACTURING PROCESS

ROLLING CUTTERS FOR DRILL BITS, AND PROCESSES TO PRODUCE SAME

This is a division of application Ser. No. 633,508 filed July 23, 1984 now U.S. Pat. No. 4,562,892.

BACKGROUND OF THE INVENTION

This invention relates generally to conical cutters utilized in roller bits employed in the oil-well-drilling industry and in mining and, more particularly concerns unique combinations including materials, that make up the composite cone and a unique manufacturing process by which the said composite cones are formed. The description of the invention that follows relates to three-cone rolling cutter bits manufactured for the oil and gas industry; however, the invention is applicable to other types of bits utilizing conical rolling cutters, such as two-cone rolling cutter bits, geothermal and mining bits. Of primary importance from bit manufacturing and design points of view is the assurance that the bit will exhibit the desired cutting action, that it will leave no rings of uncut formation on the hole bottom, that it will be capable of drilling at an economically-acceptable rate of penetration (into the rock formation), and that the bearing and cutting structures are sufficiently durable so that the bit can achieve maximum drilling footage at its maximum rate of penetration. Among these, rate of penetration and structural durability to achieve drilling depths are the most important factors from the user's point of view and are related to the subject matter of this invention.

The invention is primarily concerned with the cutting elements which are integral with the cone structure, as opposed to carbide cutting elements which are fitted into holes drilled into the cone, as is the practice presently. As the bit is rotated, the cones roll around the bottom of the hole, each tooth intermittently penetrating into the rock, crushing, chipping and gouging it. The cones are designed so that the teeth intermesh, to facilitate cleaning. In soft rock formations, long, widely-spaced steel teeth are used which easily penetrate the formation.

The present state-of-the-art manufacturing methods usually involve forging, then machining, of the cone followed by hardfacing of the steel teeth. Hardfacing is applied in a way to provide not only a hard-wear resistant layer to reduce the rate at which the cutting elements (teeth) are worn off, but to provide a sharp cutting edge as the tooth wears. This manufacturing scheme, however, is heavily labor dependent, and imprecise in that hardfacing deposit thickness, as well as its chemical composition, is not normally uniform. This is a consequence of several factors which the conventional manufacturing methods cannot, in a practical and commercially-viable sense, control.

Consider first how the hardfacing operation is performed. A rod of the hard-wear resistant alloy is fed into a jet of hot welding arc or flame. Heat causes the rod to melt and deposit onto the steel tooth which also becomes hot and partially molten. Then, the deposit is allowed to solidify. Even if one assumes that the hardfacing alloy is introduced uniformly and the heat is applied uniformly, both of which are usually not achieved, the natural phenomena that determine the way the molten deposit freeezes, are not controlled. For example, the rate of removal of heat from the molten puddle is not uniform, because the steel tooth shape is not uniform. Consequently, tooth tips remain hot longer due to insufficient chilling action of the tooth section there, while at the root of the tooth, the massive steel cone body extracts heat quickly and solidification occurs rapidly. This can easily produce a deposit that is non-uniform in thickness and non-uniform in chemistry in a micro-structural sense. Additionally, gravity,surface tensional forces and environmental reactions, such as oxidation, play complicated roles in preventing the formation of a uniform structurally-sound hard-faced deposit.

One objective of the present invention is to provide a uniform and structurally-sound hard-wear resistant layer or layers at the desired locations on the cone, thus improving the cutting action of the conical cutters and allowing longer drilling times at maximum rates of penetration.

Another objective of the invention is to reduce the labor content of the drill bit cone by utilizing a high-temperature/short-cycle consolidation process by which a compositely-structured cone can be produced from its powders or powder plus solid components combinations.

A further objective is to increase the freedom of material selection for the various components of the cone as a direct result of the use of a short-time/high-temperature consolidation process which does not affect the useful properties of the cone and its components. Thus, materials and material combinations heretofore not used in conical cutters of steel tooth design, may be used without fear of detrimental side effects associated with long-time/high processing operations.

PRIOR PROCESSES

Methods of manufacturing employed by different bit manufacturers are similar in their major operations. Typically, steel bars are cut to size, heated and forged to a preform which is later machined to form the outer cutting structure and inner-bearing bore. After further grinding to finalize the shape, cutter teeth are hardfaced by using any one of several fusion welding techniques, and the cone is carburized at localized surface areas. The inner radial bearing is, then either weld deposited or force fitted. Finally, the cutter is heat treated and bearings are finished machined.

The milled-tooth cone body normally requires surface hardening to withstand the erosive/abrasive effects of rock drilling. This may be accomplished by any of the widely used surface hardening techniques, such as transformation hardening, carburizing, nitriding, or hard metal coating.

In addition, interior surfaces of the cone are required in certain areas to be hard, wear and impact resistant to accomodate loading from both the thrust and the radial directions (with respect to the journal pin axial direction). Consequently, these surfaces are also hardened by a surface hardening process. On the journal side, the pin surfaces likely to contact "thrust bearing" surfaces are usually hardfaced and run against a hardened cone or a hardened nose button insert in the cone or a carburized tool steel bushing. In most roller cones, a row of uncapped balls run in races between the nose pin and the roller or journal bearing. These balls may carry some thrust loading, but their primary function is to retain the cone on the journal pin when not pressing against the bottom of the hole.

The major load is the radial load and is carried substantially either by a full complement of cylindrical rollers, or a sealed journal bearing, mostly used in oil-field drilling. The journal bearings are sometimes operated with grease lubrication and employ additional support to prolong bearing life; i.e., selflubricating porous floating rings[1], beryllium-copper alloy bearing coated with a soft metal lubricating film[2,3], a bearing with inlays of soft metal to provide lubrication and heat transfer[4], or an aluminum bronze inlay[5] in the cone as the soft, lubricating member of the journal-cone bearing couple.

The main body of the cone is usually a forging that is milled to create protruding, sharp, wide chisel-shaped teeth, as the cutting elements.

Most recently, certain powder metallurgy produced conical cutters have been proposed. Eric Drake[7,8] suggests cutting elements and conical cutters to be produced by powder metal mixing of two or more phases, and consolidation techniques where the composition could be changed gradually from surface to center. Such composite structures are stated to have a substantially continuous mechnical property gradient. Nederveen and Verburgh[6], on the other hand, suggest a drill bit cone having a solid-core member comprising the bearing surrounded by a powder-consolidated, partially-dense cone body onto which a hard metal is applied by thermal spraying. The composite cone is then hot isostatically pressed. The three layers are said to be solidly bonded providing a drill bit of superior mechanical properties, including high resistance to wear and chipping.

DEFICIENCIES OF THE PRIOR ART

As described above, milled-tooth cutters are machined from a single piece of a hardenable metal, yet various portions of the cone require differing properties which are difficult to achieve in an optimized manner using the same material and allowing it to respond to heat treatments. The additional materials are, therefore, sometimes applied through welding which results in layers of non-uniform thickness and chemistry. Thus, the existing milled-tooth cone manufacturing art provides a compromised set of engineering properties.

A further difficulty with the existing art is its large labor content, since all of the exterior and interior shapes, including cutting elements and bearings, are developed by milling and grinding from a single forging. These milling and grinding operations, and the associated quality inspections, lengthen the manufacturing operations, thus adding substantially to the final manufacturing cost.

Cone surfaces may be treated to impart the desired localized properties; however, these treatments are usually long or inadequate, or have side effects that compromise overall properties of the cone.

In addition, hardfacing of the milled teeth, as discussed earlier, results in a non-uniformed deposit thus compromising the self-sharpening effect (expected only when one side of the tooth is hardfaced), and occasionally creates "notch-like" intrusions of the deposited alloy into the forged cone body, thus weakening it.

The recently-provided powder metallurgy methods to produce conical cutters suffer from several disadvantages as well. The compositional gradient, to produce a properties gradient, suggested by Drake [7], is not only complicated and time consuming to produce, but could, in fact, produce the opposite effect, namely create a region of inferior properties within the gradient zone. The compositional gradient, after all, is a continual dilution of the alloys present at the extremities. "Dilution," as is well known by those who are familiar with the metallurgical arts, is a major problem where a high-hardness, high-carbide content alloy is fusion-welded onto an alloy of differing, yet purer, composition. The "diluted" region is the region between the two alloys and is formed by mixing of the two alloys, thus creating a layer of high brittleness and low strength. Such is the danger associated with the conical cones provided by Drake.

As contrasted with such prior techniques, the present invention deliberately avoids alloy gradients, in view of the problem referred to. This is accomplished through applications of discrete layers of differing materials and by use of the short-time hot-pressing technique where atomic diffusion is limited only to the interface to form a strong metallurgical bond, but not to cause excessive mixing (dilution).

Nederveen and Verburgh's[6]powder metallurgy cutters utilize high-temperature spraying techniques to apply powders to form surface layers. This approach most readily incorporates oxides into the alloy layer and the alloy layer/cone-body interface, which weaken the structure. The present invention, on the other hand, accomplishes the cladding (applying a layer of one metal on the other) by room-temperature painting, spraying or dipping in a slurry of the powder metal, and thus provides a means to produce conical cutters of superior quality.

Additionally, Nederveen and Verburgh[6] refer to the use of a single, solid-interior metal member to be used as the bearings portion of the cone. This expectably creates a compromise in properties needed for the radial bearing where the alloy is to be soft and malleable as against the alloy layer for the thrust and ball bearings where the surface needs to be more rigid to prevent slackening of the clearance between the cone and the journal pin. A tight maintenance of the tolerances is a must, especially if the bearings are protected by a sealed-in lubricant. An increase in the "clearance" or the "tolerances" in service can shorten the seal life. The present invention, on the other hand, provides different materials for the different bearing surfaces in the interior of the cone.

SUMMARY OF THE INVENTION

It is a major object of the invention to provide manufacturing methods that eliminate separate surface hardening or modification treatments for different cone surfaces and replace them with simple, low-temperature painting, or slurry dipping or spraying, or inserting operations. Desired localized properties are obtained by applications of selected powders or shaped inserts rather than by thermal treatments, thus providing a wider selection of property variation for a more precise means of meeting external wear, impact or simple loading requirements.

The subject processes involve near isostatic hot pressing of cold-formed powders. See U.S. Pat. Nos. 3,356,496 and 3,689,259. The basic process, isostatically hot presses in a matter of a few minutes, producing properties similar to those produced by the conventional Hot Isostatic Pressing (HIP) process without the lenghty thermal cycle required by HIPing.

The resultant roller bit cutter basically comprises:

(a) a tough, metallic, generally conical and fracture resistant core having a hollow interior, the core defining an axis, (b) an annular, metallic, radial bearing layer carried by said core at the interior thereof to support the core for rotation, said bearing layer extending about said axis, (c) a wear resistant outer metallic layer on the exterior of the core.

(d) metallic teeth integral with the core and protruding outwardly therefrom, at least some of said teeth spaced about said axis, (e) and an impact and wear resistant layer on each tooth to provide hard cutting edges as the bit cutter is rotated about said axis.

Further, and as will be seen, an impact and wear resistant metallic inner layer may be employed on the core at the interior thereof, to provide an axial thrust bearing; the outer layer on the core preferably covers the core between the teeth; the layer on each tooth may consist of tungsten carbide; and at least one and preferably all the layers consist of consolidated powder metal.

In addition, the core typically consists essentially of steel alloyed with elements that include carbon, manganese, silicon, nickel, chromium, molybdenum, and vanadium, or the core may consist of cast alloy steel, or of ultra high strength steel. The outer layer may consist of a composite mixture of refractory particles in a binder metal such particles typically having micro hardness in excess of 1,000 kg/mm$^2$, and melting point in excess of 1,600° C. Also, the refractory particles are typically selected from the group consisting of Ti, W, Al, V, Zr, Cr, Mo, Ta, Nb, Hf, and carbides, oxides, nitrides and borides thereof. As, an alternative, the outer layer may consist of tool steel initially in powder form, or of a hardfacing alloy, as will be seen, or of wear resistant, intermetallic Laves phase materials, as will appear.

These and other objects and advantages of the invention, as well as the details of an illustrative embodiment, will be more fully understood from the following specification and drawings in which:

DRAWING DESCRIPTION

Figure 2A:
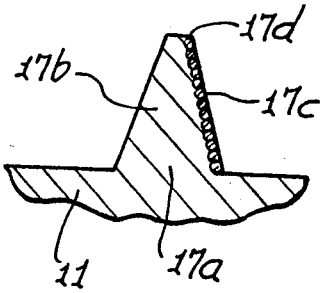
FIG. 2 is an elevation, in section, showing a milled tooth conical cutter.
Figure 3:
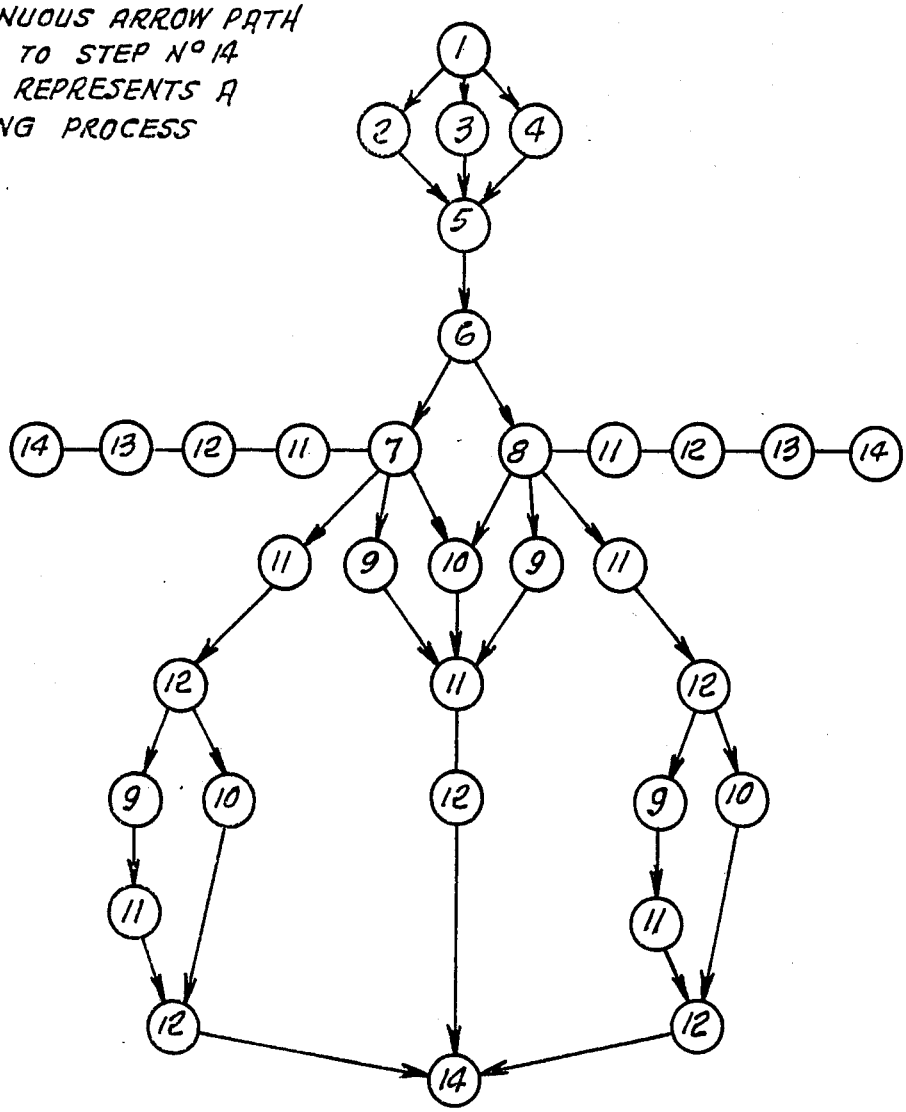
Figure 6:
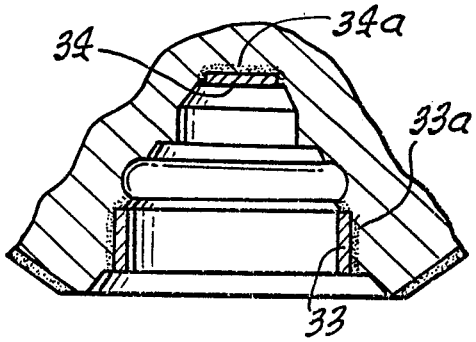
Figure 7:
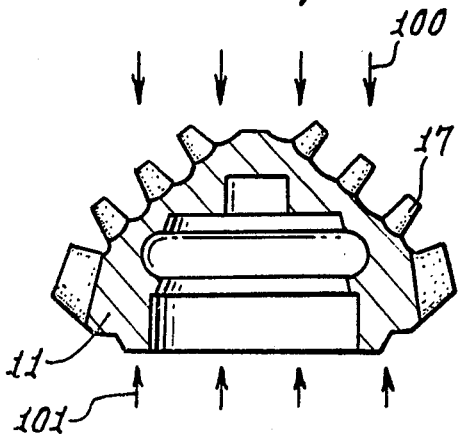
Figure 4A:
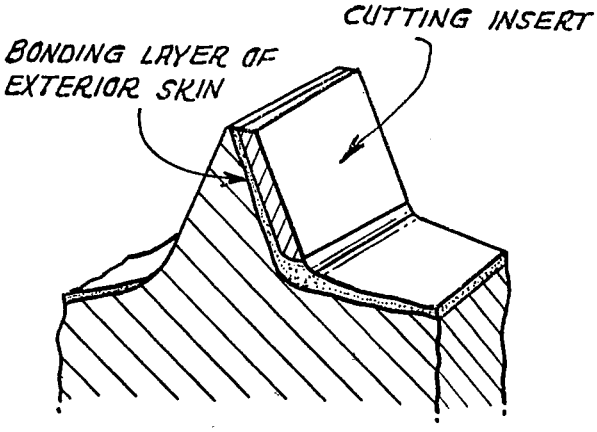
Figure 4B:
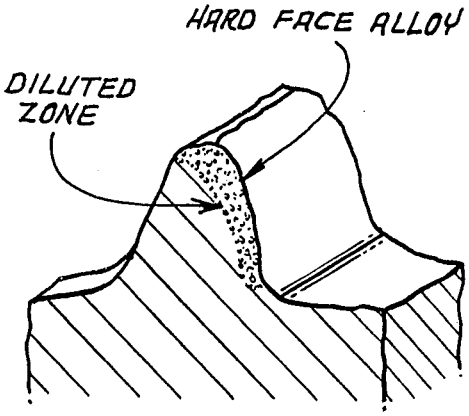
Figure 4C:
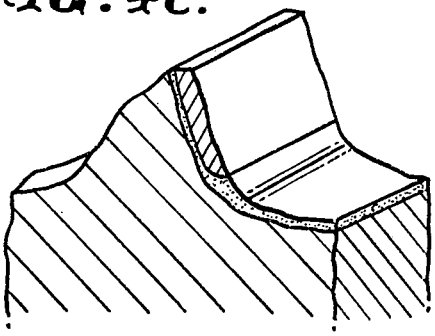
Figure 4D:
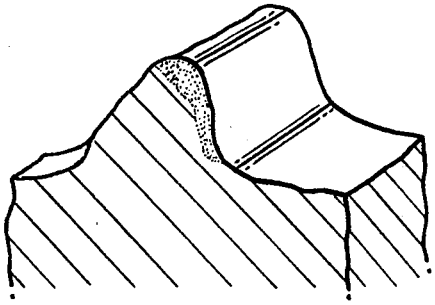
Figure 5A:
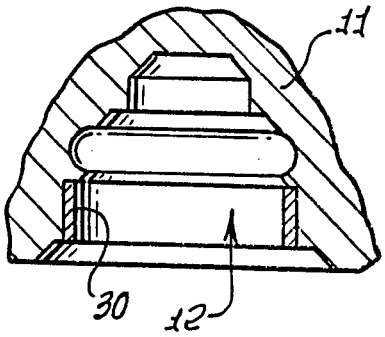
Figure 5B:
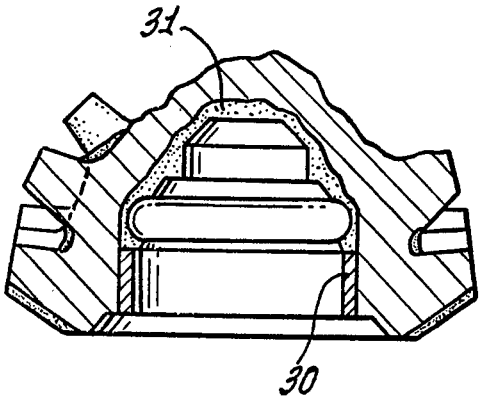
Figure 5C:
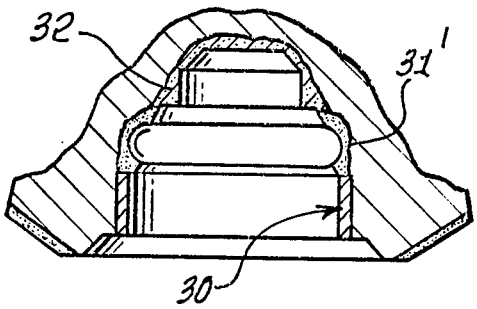
Figure 5D:
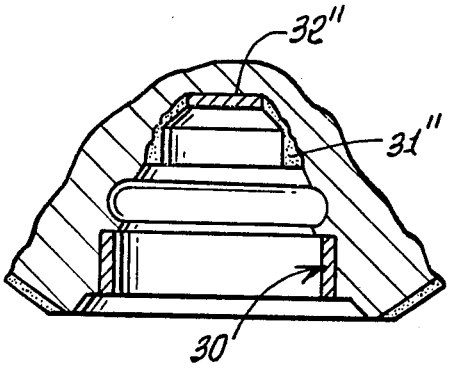
Figure 8:
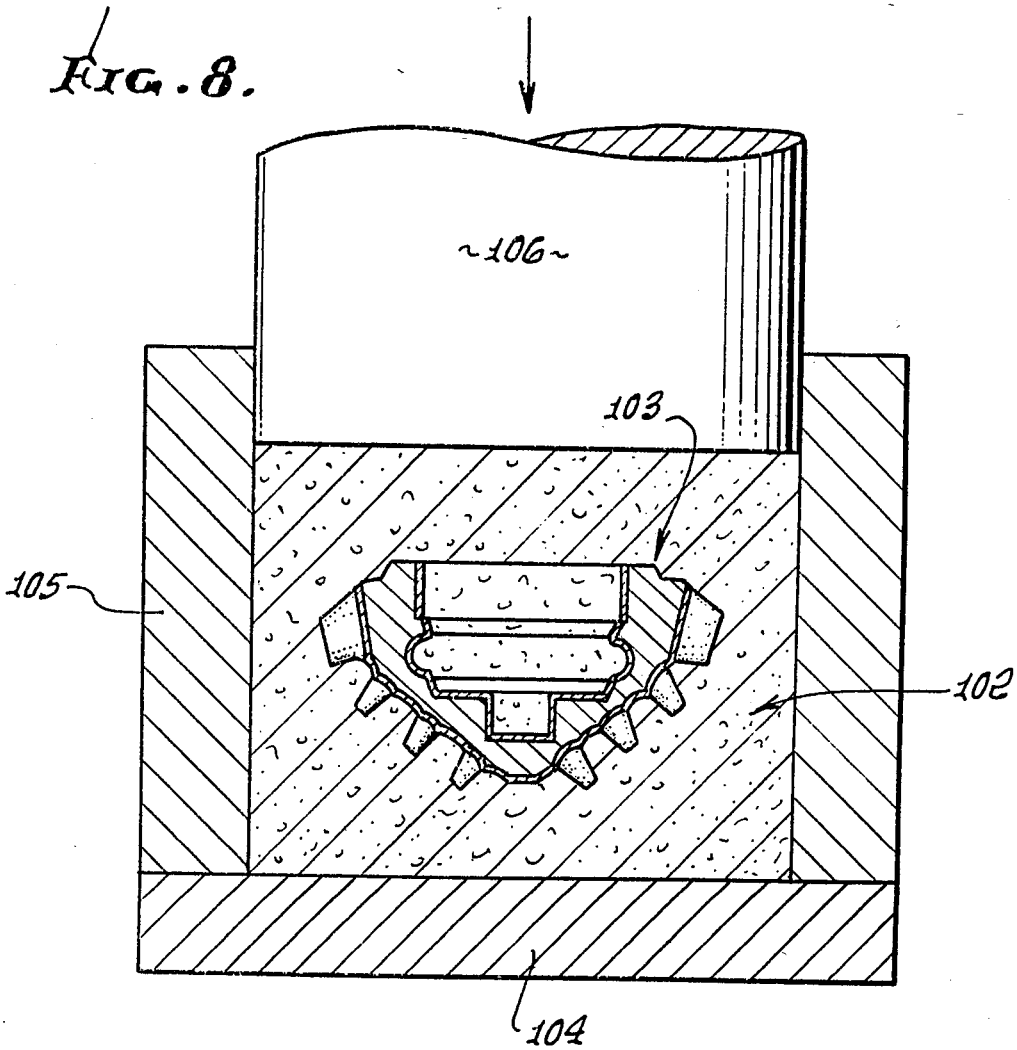

FIG. 2*a* is a cross section taken through a tooth insert;

FIG. 3 is a flow diagram showing steps of a manufacturing process for the composite conical drill bit cutter;

FIGS. 4(*a*) and 4(*c*) are perspective views of a conical cutter tooth according to the invention, respectively before and after downhole service use; and FIGS. 4(*b*) and 4(*d*) are perspective views of a prior design hardfaced tooth, respectively before and after downhole service;

FIGS. 5(*a*)–5(*d*) are elevations, in section, showing various bearing inserts employed to form interior surfaces of proposal conical cutters; and FIG. 6 is an elevation, in section, showing use of of powdered metal bonding layer between a bearing insert and the core piece, and FIGS. 7 and 8 show process steps.

DETAILED DESCRIPTION

Figure 1:
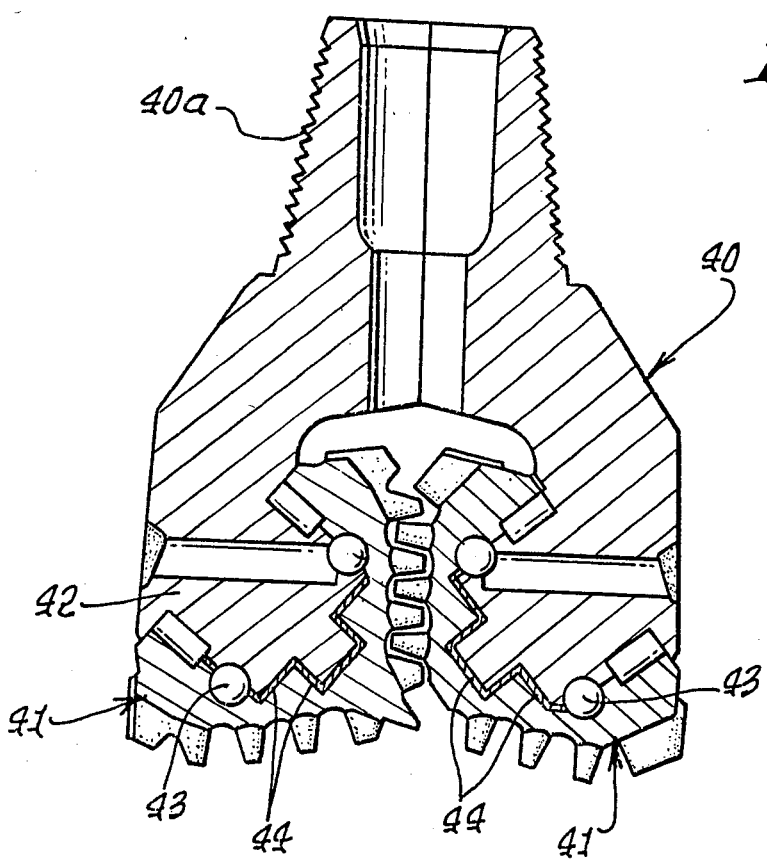
FIG. 1 is an elevation, in section, showing a two-cone rotary drill bit, with intermeshing teeth to facilitate cleaning.

In FIG. 1, the illustrated improved roller bit cutter 10 incorporating the invention includes a tough, metallic, generally conical and fracture resistant core 11. The core has a hollow interior 12,and defines a central axis 13 of rotation. The bottom of the core is tapered at 14, and the interior includes multiple successive zones 12*a*, 12*b*, 12*c* and 12*e* concentric to axis 13, as shown. An annular metallic radial (sleeve type) bearing layer 15 is carried by the core at interior zone 12*a* to support the core for rotation. Layer 15 is attached to annular surface 11*a* of the core, and extends about axis 13. It consists of a bearing alloy, as will appear.

An impact and wear resistant metallic inner layer 16 is attached to the core at its interior zones 12*b*–12*e*, to provide an axial thrust bearing; as at end surface 16*a*. A plurality of hard metallic teeth 17 are carried by the core, as for example integral therewith at the root ends 17*a* of the teeth. The teeth also have portions 17*b* that protrude outwardly, as shown, with one side of each tooth carrying an impact and wear resistant layer 17*c* to provide a hard cutting edge 17*d* as the bit cutter rotates about axis 13. At least some of the teeth extend about axis 13, and layers 17*c* face in the same rotary direction. One tooth 17′ may be located at the extreme outer end of the core, at axis 13. The teeth are spaced apart.

Finally, a wear resistant outer metallic skin or layer 19 is on and attached to the core exterior surface, to extend completely over that surface and between the teeth 17.

In accordance with an important aspect of the invention, at least one or two layers 15, 16 and 19 consists essentially of consolidated powder metal, and preferably all three layers consist of such consolidated powder metal. A variety of manufacturing schemes are possible using the herein disclosed hot pressing technique and the alternative means of applying the surface layers indicated in FIG. 2. It is seen from the previous discussion that surface layers 15, 16 and 19 are to have quite different engineering properties than the interior core section 11. Similarly, layers 16 and 19 should be different than 15, and even 16 should differ from 19. Each of these layers and the core piece 11 may, therefore, be manufactured separately or applied in place as powder mixtures prior to cold pressing. Thus, there may be a number of possible processing schemes as indicated by arrows in FIG. 3. The encircled numbers in this figures refer to the possible processing steps (or operations) listed in below Table 1. Each continuous path in the figure, starting from Step No. 1 and ending at Step No. 15, defines separate processing schemes which, when followed, are capable of producing integrally consolidated composite conical cutters.

TABLE 1

A list of major processing steps which may be included in the processing:

1. Blend powders.
2. Cold press powder to pre-form green interior core piece 11 (see FIG. 2 for location), which includes teeth 17.
3. Cold press and sinter or hot press powder to preform, less than fully dense, core piece 11. Sintering or hot pressing can usually be done at a preferred temperature range 1800° F. to 1250° F. If sintered, typical sintering times may be 0.5 to 4 hours depending on temperature.
4. Forge or cast fully dense core piece 11.
5. Apply powdered hard metal compound skin 19; i.e., by painting, slurry dipping or cold spraying a hard metal powder mixed with a fugitive organic binder and a volatile solvent.
6. Place tungsten carbide inserts 17*c* on teeth faces.

7. Apply thrust-bearing alloy powder layer 16; i.e., by painting, slurry dipping or cold spraying an alloy-binder mixture as in Step 5 above.
8. Apply powdered radial bearing alloy 15 in the core piece; i.e., by painting, slurry dipping or cold spraying an alloy-binder mixture as in Step 5 above.
9. Apply powdered radial bearing alloy 15 in the cold piece; i.e., by painting, slurry dipping or cold spraying an alloy-binder mixture as in Step 5 above.
10. Place wrought, cast or sintered powder metal radial bearing alloy 15 in the core piece 11.
11. Bake or dry to remove binder from powder layers 15, 16 and/or 19. Drying may be accomplished at room temperature overnight. If slurry applied layers are thick the preform may be baked in non oxidizing atmosphere at 70°–300° F. for several hours to assure complete volatilization of the volatile portion of the binder.
12. Hot press to consolidate the composite into a fully dense (99+ of theoretical density) conical cutter. Typically, hot pressing temperature range of 1900°–2300° F. and pressures of 20 to 50 tons per square inch may be required.
13. Weld deposit radial-bearing alloy 15 in the densified cone.
14. Final finish; i.e., grind or machine ID profile, finish grind bearings, finish machine seal seat, inspect, etc.

The processing outlined include only the major steps involved in the flow of processing operations. Other secondary operations that are routinely used in most processing schemes for similarly manufactured products, are not included for sake of simplicity. These may be cleaning, manual patchwork to repair small defects, grit blasting to remove loose particles or oxide scale, dimensional or structural inspections, etc.

All of the processing steps are unique, as may easily be recognized by those who are familiar with the metallurgical arts in the powder metals processing filed. Each scheme provides a number of benefits from the processing point of view, and some of which are listed as follows:

(1) All assembly operations; i.e., painting, spraying, placing, etc., in preparing the composite cutter structure for the hot-pressing operation (Step No. 12 in Table 1) are performed at or near room temperature. Thus, problems associated with thermal porperty differences or low strength, unconsolidated state of the composite cone prior to hot densification, are avoided. Repair work, geometrical or dimensional control, and in-process handling are greatly simplified.

(2) Application of powdered metal or alloy or metal compound surface layers, using volatile binders, such as cellulose acetate, corn starch and various distilled products, provide sturdy powder layers strongly held together by the binding agent, thus adding to the green strength of the total unconsolidated cone structure. This makes it easy to control surface layer thickness, handling of the assembly in processing and provides mechanical support for the carbide inserts.

(3) Low-temperature application of aforementioned surface layers avoids pitfalls associated with high-temperature spraying of powders.

(4) The proposed schemes in every case produce a near-net-shape product, greatly reducing the labor-intensive machining operations required in the conventional conical cutter production.

PROPOSED CONE MATERIALS

Figure 2:
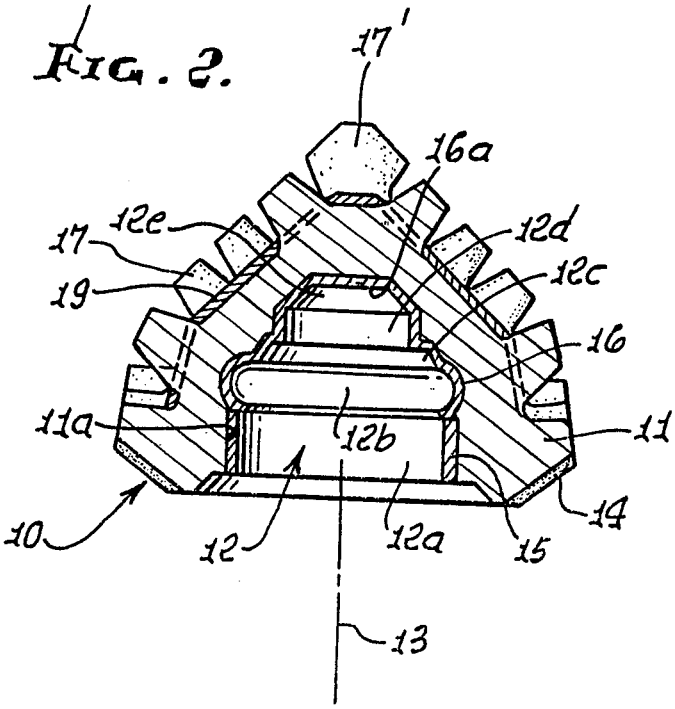

Various sections of the cone cross-section have been identified in FIG. 2, each requiring different engineering properties to best function in service. Consequently, materials for each section should be selected separately.

Interior core piece 11 should be made of an alloy possessing high strength and toughness, and preferably require thermal treatments below 1700° F. (to reduce damage due to cooling stresses) to impart its desired mechanical properties. Such restrictions can be met by the following classes of materials:

(1) Hardening grades of low-alloy steels (ferrous base) with carbon contents ranging nominally between 0.1 and 0.65%, manganese 0.25 to 2.0%, silicon 0.15 to 2.2%, nickel to 3.75%, chromium to 1.2%, molybdenum to 0.40%, vanadium to 0.3% and remainder substantially iron, total of all other elements to be less than 1.0% by weight.

(2) Castable alloy steels having less than 8% total alloying element content; most typically ASTM-AL48-80 grades.

(3) Ultra-high strength steels most specifically known in the industry as: D-6A, H-11, 9Ni-4Co, 18-Ni maraging, 300-M, 4130, 4330 V, 4340. These steels nominally have the same levels of C, Mn, and Si as do the low-alloy steels described in (1) above. However, they have higher contents of other alloying elements: chromium up to 5.0%, nickel to 19.0%, molybdenum to 5.0%, vanadium to 1.0%, cobalt to 8.0%, with remaining substantially iron, and all other elements totaling less than 1.0%.

(4) (Ferrous) powder metal steels with nominal chemistries falling within: 79 to 98% iron, 0–20% copper, 0.4 to 1.0 carbon, and 0.4.0% nickel.

(5) Age hardenable and martensitic stainless steels whose compositions fall into the limits described in (3) above, except that they may have chromium up to 20%, aluminum up to 2.5%, titanium up to 1.5%, copper up to 4.0%, and columbium plus tantalum up to 0.5%.

In all cases, the core piece mechanical properties should exceed the following:

130 ksi ultimate tensile strength
80 ksi yield strength
5% tensile elongation
15% reduction in area
10 ft-lb (izod) impact strength Wear-resistant exterior skin 19, which may have a thickness within 0.01 to 0.20 inch range, need not be uniform in thickness. Materials suitable for the cone exterior include:

(1) A composite mixture of particles of refractory hard compounds in a binding metal or alloy where the refractory hard compounds have a micro-hardness of higher than 1,000 kg/mm$^2$ (50–100 g testing load), and a melting point of 1600° C. or higher in their commercially pure forms, and where the binding metal or alloy may be those based on iron, nickel, cobalt or copper. Examples of such refractory hard compounds include carbides, oxides, nitrides and borides (or their soluble mixtures)of the Ti, W, Al, V, Zr, Cr, Mo, Ta, Nb and Hf.

(2) Specialty tool steels, readily available in powder form, having large amounts of strong carbide formers such as Ti, V, Nb, Mo, W and Cr, and a carbon content higher than 2.0% by weight.

(3) Hardfacing alloys based on transition elements Fe, Ni, or Co, with the following general chemistry ranges:

| | Cobalt Base | Nickel Base | Iron Base |
|---|---|---|---|
| Chromium | 25–30%(*) | 10–30% | 0–27% |
| Carbon | 0.1–3.5% | 0.4–3.0% | 0.1–4.0% |
| Tungsten | 4–13% | 0–5.0% | — |
| Molybdenum | 0–5% | 0–17.0% | 0–11% |
| Boron | 0–2.5% | 0–5.0% | — |
| Iron | 0–3.0% | 329% | Balance |
| Nickel | 0–3.0% | Balance | 0–1.75% |
| Cobalt | Balance | 0–12% | — |
| Silicon | 0–2.0% | 0–4.5% | 0–1.5% |
| Managanes | 0–1.0% | 0–1.0% | 0–1.0% |

*percentage by weight (4) Wear-resistant intermetallic (Laves phase) materials based on cobalt or nickel as the primary constituent and having molybdenum (25–35%), chromium (8–18%), silicon (2–4%) and carbon 0.08% maximum.

Thrust-bearing 16 may be made of any metal or alloy having a hardness above 35 $R_c$. They may, in such cases, have a composite structure where part of the structure is a lubricating material such as molybdenum disulfide, tin, copper, silver, lead or their alloys, or graphite.

Cobalt-cemented tungsten carbide inserts 17*c* cutter teeth 17 in FIG. 2, are to be readily available cobalt-tungsten carbide compositions whose cobalt content usually is within the 5–18% range.

Bearing alloy 15, if incorporated into the cone as a separately-manufactured insert, may either be a hardened or carburized or nitrided or borided steel or any one of a number of readily available commercial non-ferrous bearing alloys, such as bronzes, If the bearing is weld deposited, the material may still be a bronze. If, however, the bearing is integrally hot pressed in place from a previously applied powder, or if the insert is produced by any of the known powder metallurgy techniques, then it may also have a composite structure having dispersed within it a phase providing lubricating properties to the bearing.

EXAMPLES

An example for the processing of roller cutters includes the steps 1, 3, 5, 6, 7, 10, 11, 12 and 14 provided in Table 1. A low alloy steel composition was blended to produce the final chemical analysis: 0.22% manganese, 0.23% molybdenum, 1,84% nickel, 0.27% carbon and remainder substantially iron. The powder was mixed with a very small amount of zinc stearate, for lubricity, and cold pressed to the shape of the core piece 11 (FIG. 2) under a 85 ksi pressure. The preform was then sintered for one hour at 2050° F. to increase its strength.

A slurry was prepared of Stellite No. 1 alloy powder and 3% by weight cellulose acetate and acetone in amounts adequate to provide the desired viscosity to the mixture. The Stellite No. 1 nominal chemistry is as follows: 30% chromium (by weight), 2.5% carbon, 1% silicon, 12.5% tungsten, 1% maximum each of iron and nickel with remainder being substantially cobalt. The slurry was applied over the exterior surfaces of the core piece using a painter's spatula, excepting those teeth surfaces where in service abrasive wear is desired in order to create self-sharpening effect. Only one side of the teeth was thereby covered with the slurry and before the slurry could dry to harden, 0.08" thick cobalt cemented (6% cobalt) tungsten carbide inserts (FIG. 4, *a*) were pressed into the slurry. Excess slurry at the carbide insert edges were removed and interfaces smoothed out using the spatula.

A thin layer of an alloy steel powder was similarly applied, in a slurry state, on thrust bearing surfaces identified as 16 in FIG. 2. The thrust bearing alloy steel was identical in composition to the steel used to make the core piece, except the carbon content was 0.8% by weight. Thus, when given a hardening and tempering heat treatment the thrust bearing surfaces would harden more than the core piece and provide the needed wear resistance.

An AISI 1055 carbon steel tube having 0.1" wall thickness was fitted into the radial bearing portion of the core piece by placing it on a thin layer of slurry applied alloy steel powder. used for the core piece.

The preform assembly, thus prepared, was dried in an oven at 100° F. for overnight, driving away all volatile constituents of the slurries used. It was then induction heated to about 2250° F. within four minutes and immersed in hot ceramic grain, which was also at 2250° F., within a cylindrical die. A pressure of 40 tons per square inch was applied to the grain by way of an hydraulic press. The pressurized grain transmitted the pressure to the preform in all directions. The peak pressure was reached within 4–5 seconds, and the peak pressure was maintained for less than two seconds and released. The die content was emptied,separating the grain from the now consolidated roller bit cutter. Before the part had a chance to cool below 1600° F., it was transferred to a furnace operating at 1565° F., kept there for one hour and oil quenched. To prevent oxidation the furnace atmosphere consisted of non-oxidizing cracked ammonia. The hardened part was then tempered for one hour at 1000° F. and air cooled to assure toughness in the core.

A similarly processed tensile test bar when tensile tested exhibited 152 ksi ultimate tensile strength, 141 ksi yield strength, 12% elongation and 39% reduction of area. Another test bar which was processed in the same manner as above, except tempered at 450° F., exhibited 215 ksi ultimate tensile strength, 185 ksi yield strenght, 7% elongation and 21% reduction of area. Thus, it is apparent that one may easily develop a desired set of mechanical properties in the consolidated core piece by tempering at a selected temperature.

In another example, powder slurry for the wear resistant exterior skin and the thrust bearing surface was prepared using a 1.5% by weight mixture of cellulose acetate with Stellite alloy No. 1 powder. This preform was dried at 100° F. for overnight instead of 250° F. for two hours, and the remaining processing steps were identical to the above example. No visible differences were detected between the two parts produced by the two experiments.

In yet another example, radial bearing alloy was affixed on the interior wall of the core through the use of a nickel powder slurry similarly prepared as above. Once again the bond between the radial bearing alloy and the core piece was extremely strong as determined by separately conducted bonding experiments.

OTHER PERTINENT INFORMATION

The term "composite" is used both in the microstructural sense or from an engineering sense, whichever is more appropriate. Thus, a material made up of discrete fine phase(s) dispersed within another phase is considered a composite of phases, while a structure made up of discrete, relatively large regions joined or assembled by some means, together is also considered a "composite." An alloy composed of a mixture of carbide particles in cobalt, would micro-structurally be a composite layer, while a cone cutter composed of various distinct layers, carbide or other inserts, would be a composite part.

The term "green" in Table 1, line 2, referes to a state where the powder metal part is not yet fully densified but has sufficient strength to be handled without chipping or breakage. Sintering (the same table, line 3) is a process by which powdered (or otherwise) material is put in intimate contact and heated to cause a metallurgical bond between them.

This invention introduces, for the first time, the following novel features to a drill bit cone:

(1) A "high-temperature - short-heating cycle" means of consolidation of a composite cone into a nearly finished product, saving substantial labor time. and allowing the use of multiple materials tailored to meet localized demands on their properties.

(2) Application of material layers at or near room temperature, which eliminates thermally-induced structural damage if a thermally-activated process were to be used.

(3) A "high-temperature - high-pressure - short-time" processing scheme, as outlined in FIG. 3, where time-temperature dependent diffusion reactions are substantially reduced.

(4) A rock bit conical cutter having a hard, wear-resistant exterior skin and an interior profile which may consist of a layer bearing alloy or two different alloys, one for each radial and thrust bearings; all of which substantially surround a high-strength, tough core piece having protruding teeth.

(5) A conical cutter same as in Item (4), but having teeth partially covered on one side with an insert, preferably a cobalt-cemented tungsten carbide insert, which is bonded onto the interior core piece 11 by a thin layer of a carbide-rich hard alloy similar to those used for the exterior skin 19. This is illustrated in FIGS. 4(*a*) and 4(*c*), and is intended to provide a uniform, hard-cutting edge to the cutting teeth as they wear in downhole service; i.e., self-sharpening of teeth (see FIG. 4(*c*). This is to be contracted with problems of degradation of the cutting edge encountered in hardfaced teeth (see FIGS. 4(*b*) and 4(*d*))

(6) A conical cutter, as in Item (5), but having interior bearing surfaces provided by pre-formed and shaped inserts prior to hot consolidation of the composite cone. These inserts may be one or more pieces, at least one of which is the radial-bearing piece. Thrust bearing may be provided in the form of a single insert, or two or more inserts, depending on the cone interior design. These variations are illustrated in FIGS. 5(*a*)–5(*d*). FIG. 5(*a*) shows one insert 30; FIG. 5(*b*) shows a second insert 31 covering all interior surfaces, except for insert 30; FIG. 5(*c*) shows a third insert 32 combined with insert 30 and a modified second insert 31'; and FIG. 5(*d*) shows modified second and third inserts 31'' and 32''.

(7) A conical cutter, as in Item (6), but having interior bearing inserts 33 and 34 bonded onto the interior core piece 11 by a thin layer or layers 33*a* and 34*a* of a ductile alloy, as illustrated in FIG. 6.

(8) A conical cutter same as in (5), but interior bearings surface is provided by a powder metallurgically applied layer of a bearing alloy.

FIG. 1 shows a bit body 40, threaded at 40*a*, with concial cutters 41 mounted to journal pins 42, with ball bearings 43 and thrust bearings 44.

Step 3 of the process as listed in Table 1 is for example shown in FIG. 7, the arrows 100 and 101 indicating isostatic pressurization of both interior and exterior surfaces of the core piece 11. Note that the teeth 17 are integral with the core-piece and are also pressurized. Pressure application is effected for example by the use of rubber molds or ceramic granules packed about the core and teeth, and pressurized. Step 12 of the process as listed in Table 1 is for example shown in FIG. 8. The part as shown in FIG. 2 is embedded in hot ceramic grain or particulate 102, contained within a die 103 having bottom and side walls 104 and 105. A plunger 106 fits within the cylindrical bore 105*a* and presses downwardly on the hot grain 102 in which consolidating force is transmitted to the part, generally indicated at 106. Accordingly, the core 11 all components and layers attached thereto as referred to above are simultaneously consolidated and bonded together.

REFERENCES

1. R. K. Sorensen and A. T. Rallis, "Journal and Pilot Bearings with Alternating Surface Areas of Wear-Resistant and Anti-Galling Materials, " U.S. Pat. No. 3,984,158 (Oct. 5, 1976)
2. H. W. Murdoch, "Drill Bit," U.S. Pat. No. 4,074,922 (Feb. 21, 1978)
3. T. H. Mayo, "Drill Bit Bearings," U.S. Pat. No. 3,721,307 (Mar. 20, 1971)
4. J. R. Whanger, "Journal Bearing with Alternating Surface Areas of Wear-Resistant and Anti-Galling Materials, " U.S. Pat. No. 3,235,316 (Feb. 15, 1966)
5. J. R. Quinlan, "Aluminum Bronze Bearing," U.S. Pat. No. 3,995,017 (Dec. 7, 1976)
6. Hans B. Van Nederveen, Bosch en Duin and Martin B. Verburgh, "Drill Bit," U.S. Pat. No. 4,365,679 (Dec. 28, 1982)
7. Eric F. Drake, "Metal Cutting Tools Utilizing Gradient Composites," U.S. Pat. No. 4,368,788 (Jan. 18, 1983)
8. Eric F. Drake, "Cutting Teeth for Rolling Cutter Dril Bit," U.S. Pat. No. 4,372,404 (Feb. 8, 1983)

I claim:

1. The method of producing a roller bit cutter, that includes the steps (a) providing a tough, metallic, generally conical and fracture resistant core having a hollow interior, the core defining an axis, (b) providing an annular, metallic, radial bearing layer carried by said core at the interior thereof to support the core for rotation, said bearing layer extending about said axis, (c) providing a wear resistant outer metallic layer on the exterior of the core, (d) the core including metallic teeth integral with the core and protruding outwardly therefrom, at least some of said teeth spaced about said axis, (e) and providing an impact and wear resistant layer on each tooth to provide hard cutting edges as the bit cutter is rotated about said axis, (f) at least one of said core and layers being provided by application of powder metal in a suitable binder, the binder subsequently volatilized and the powder metal consolidated in a granular bed via which pressure is transmitted to said metal powder.

2. The method of claim 1, including (a) providing an impact and wear resistant metallic inner layer on the core at the interior thereof, to provide an axial thrust bearing.

3. The method of claim 1 wherein said outer layer is applied to cover the core between said teeth.

4. The combination of claim 1 wherein said layer on each tooth consists essentially of tungsten carbide.

5. The method of claim 1 wherein said one of the core and layers is initially provided in preform state wherein the powder metal is mixed with said binder, and wherein the preform after said volatilization is embedded in said granular bed via which said pressure is applied to the preform to consolidate the metal powder to form an integral body.

6. The method of one of claims 1–4 wherein at least one of said layers consists essentially of consolidated powder metal.

7. The method of one of claims 1–4 wherein at least two of said layers consist essentially of consolidated powder metal.

8. The method of claims 1–4 wherein at least three of said layers consist essentially of consolidated powder metal, and said core consists essentially of steel.

9. The method of one of claims 1–4 wherein all of said layers consist essentially of consolidated powder metal.

10. The method of claim 1 wherein said core consists essentially of steel alloyed with elements that include carbon, manganese, silicon, nickel, chromium, molybdenum, and copper.

11. The method of claim 10 wherein said elements have the following weight percents:

| | |
|---|---|
| carbon | 0.1 to 0.65 |
| manganese | 0.25 to 2.0 |
| silicon | 0.15 to 2.2 |
| nickel | 0.01 to 3.75 |
| chromium | 0.01 to 1.2 |
| molybdenum | 0.01 to 0.40 |
| copper | 0 to 0.3 |

12. The method of claim 1 wherein said core consists essentially of cast alloy steel.

13. The method of claim 11 wherein said core consists of ultra high strength steel.

14. The method of claim 13 wherein said steel is selected from the group consisting of D-6A, H-11, 9Ni-4Co, 18-Ni maraging, 300-M, 4134, 4330 V and 4340.

15. The method of claim 1 wherein said core consists of consolidated ferrous powder metal steel having the following composition, indicated percentages being by weight:

| | |
|---|---|
| iron | 79 to 98% |
| copper | 0 to 20% |
| carbon | 0.4 to 1.0% |
| nickel | 0 to 4.0% |

16. The method of claim 1 wherein said core consists of age hardenable and martensitic stainless steel alloyed with elements that include the following with indicated weight percents:

| | |
|---|---|
| chromium | 0 to 20% |
| aluminum | 0 to 2.5% |
| titanium | 0 to 1.5% |
| copper | 0 to 4.0% |
| columbium plus | 0 to 0.5% |

-continued

| |
|---|
| tantalum |

17. The method of any one of claims 1 or 10–16 wherein the core has mechanical properties in excess of the following lower limits:

| | |
|---|---|
| 130 | ksi ultimate tensile strength |
| 80 | ksi yield strength |
| 5% | tensile elongation |
| 15% | reduction in area |
| 10 | ft-lb (izod) impact strength |

18. The method of claim 1 wherein said outer layer consists of a composite mixture of refractory particles in a binder metal.

19. The method of claim 18 wherein said refractory particles have micro hardness in excess of 1,000 kg/mm$^2$, and a melting point in excess of 1,600° C.

20. The method of claim 18 wherein said refractory particles are selected from the group consisting of Ti, W, Al, Vm, Zr, Mo, Ta, Nb, Hf, and carbides, oxides, nitrides, and borides thereof.

21. The method of claim 1 wherein said outer layer consists of tool steel initially in powder form.

22. The method of claim 5 wherein said core together with said layer or layers are simultaneously consolidated by said pressure application via said granular matrix in a die, said core and said layer or layers having been preliminarily embedded in said matrix.

23. The method of producing a roller bit cutter, includes the steps:

(a) providing a tough, metallic, generally conical and fracture resistant core member having a hollow interior, the core defining an axis, (b) providing an annular, metallic, radial bearing layer carried by said core at the interior thereof to support the core for rotation, said bearing layer extending about said axis, (c) providing a wear resistant outer metallic layer on the exterior of the core, (d) the core including metallic teeth integral with the core and protruding outwardly therefrom, at least some of said teeth spaced about said axis, (e) and providing an impact and wear resistant layer on each tooth to provide hard cutting edges as the bit cutter rotates about said axis, (f) initially assembling the above core and layers as members of a green preform, at ordinary room temperatures, by using an organic binder with and without a volatile solvent when necessary, (g) burning out the binder (and solvent) at elevated temperature, (h) immersing the heated preform assembly in a granular bed of refractory material within a metal die, and (i) applying a pressure to the granular bed, which transmits the pressure to the preform assembly, until the members of the preform assembly are substantially consolidated and bonded to each other to form a single body means with sufficient mechanical integrity to be functionally useful.

24. The method of claim 23, including (j) providing an impact and wear resistant metallic inner layer on the core at the interior thereof, to provide an axial thrust bearing.

25. The method of claim 23 wherein said outer layer is applied to cover the core between said teeth as a power metal and a liquid fugitive binder mixture.

26. The method of claim 25 wherein said outer layer is applied on the core exterior includes a powder metal mixed with a powder organic binder and a liquid volatile solvent.

27. The method of claim 23 wherein the core is a metal powder cold compressed and/or sintered to a density less than the theoretical density of the said metal.

28. The method of claim 23 wherein the core is in the form of a wrought or cast metal.

29. The method of claim 23 wherein the radial bearing layer is applied as a metal powder mixed with an organic binder.

30. The method of claim 23 wherein the radial bearing layer is applied as a wrought sintered or cast alloy insert in the process of assembling the green preform with or without any other metallic layer applied between the bearing metal layer and the core.

31. The method of claim 23 wherein the radial bearing layer is applied as a bearing alloy after the hot consolidation step (i) by a fusion process.

32. The method of claim 24 where the said thrust bearing is applied as a wrought, sintered or cast alloy insert or inserts in the process of assembling the green preform.

33. The method of claim 23 wherein at least one of the layers is metal powder compacted to a density lower than its theoretical density prior to the consolidation step (i).

34. The method of claim 23 wherein at least two of the layers are metal powder compacted to a density lower than their theoretical density prior to the consolidation step (i).

35. The method of claim 23 wherein at least three of the layers are compacted to a density lower than their respective theoretical densities prior to the consolidation step (i).

36. The method of claim 23 wherein some or all of the said layers or portions of thereof are assembled together by using a separate layer of metallic powder in between, and consolidated to incorporate such interface layers as part of the consolidated body means.

37. The method of claim 23 wherein the said impact and wear resistant layer on each tooth is applied as a mixture of metallic powders and a fugitive organic binder.

38. The method of claim 23 wherein the said impact and wear resistant layer on each tooth is applied as one or more solid inserts with or without utilizing a bonding metal powder between the tooth core and the insert.

39. The method of claim 23 wherein said outer layer consists of a composite mixture of refractory particles in a binder metal.

40. The method of claim 38 wherein the said insert is cobalt cemented tungsten carbide.

41. The method of claim 37 wherein the said layer on each tooth consists of a mixture of a binding metal and refractory hard particles.

42. The method of claim 41 wherein said refractory particles are selected from the group consisting of Ti, W, Al, V, Zr, Cr, Mo, Ta, Nb, Hf, and carbides, oxides, nitrides, and borides thereof.

43. The method of claim 41 wherein said binding metal is selected from the alloy systems based on Fe, Ni, Co, Cu, Mo and W.

* * * * *